US011877662B2

(12) United States Patent
Freelend

(10) Patent No.: US 11,877,662 B2
(45) Date of Patent: Jan. 23, 2024

(54) FOLDABLE ADJUSTABLE BED BASE WITH LEG ASSEMBLIES HAVING ADJUSTABLE LENGTHS

(71) Applicant: L & P Property Management Company, South Gate, CA (US)

(72) Inventor: Isaac T. Freelend, Sarcoxie, MO (US)

(73) Assignee: L&P Property Management Company, South Gate, CA (US)

( * ) Notice: Subject to any disclaimer, the term of this patent is extended or adjusted under 35 U.S.C. 154(b) by 102 days.

(21) Appl. No.: 17/682,574

(22) Filed: Feb. 28, 2022

(65) Prior Publication Data

US 2023/0270259 A1 Aug. 31, 2023

(51) Int. Cl.
*A47C 19/12* (2006.01)
*A47C 19/02* (2006.01)

(52) U.S. Cl.
CPC ..... *A47C 19/122* (2013.01); *A47C 19/024* (2013.01); *A47C 19/025* (2013.01)

(58) Field of Classification Search
CPC ... A47C 19/024; A47C 19/122; A47C 19/021; A47C 19/04; A47C 19/128; A47B 3/0809; A47B 3/0812; F16B 12/54; F16B 12/52; F16B 12/56; F16B 2200/99
See application file for complete search history.

(56) References Cited

U.S. PATENT DOCUMENTS 1,574,659 A * 2/1926 Johnston ..... A47C 19/122 5/57.1
2,047,389 A * 7/1936 Sinclair ..... A47B 3/0812 403/65
2,145,734 A * 1/1939 Rastetter ..... A47B 3/0812 292/76
2,660,497 A * 11/1953 Norquist ..... A47B 3/0812 108/127
2,660,498 A * 11/1953 Norquist ..... A47B 3/0812 108/125
4,494,465 A * 1/1985 Fick, Jr. ..... A47B 3/083 108/131
6,006,379 A * 12/1999 Hensley ..... A47C 20/08 5/915
10,893,756 B1 * 1/2021 Neuenswander .... A47C 19/024
11,375,805 B2 * 7/2022 Hurley ..... A47B 3/083
2015/0143630 A1 * 5/2015 Harrow ..... A47C 19/12 5/400

(Continued)

FOREIGN PATENT DOCUMENTS

GB 2215191 A * 9/1989 ..... A47B 3/0812

*Primary Examiner* — Justin C Mikowski
*Assistant Examiner* — Alison N Labarge
(74) *Attorney, Agent, or Firm* — Wood Herron & Evans LLP

(57) ABSTRACT

An adjustable bed base may be folded in half for shipping without removing the leg assemblies. The leg assemblies are adjustable in length and may be secured in a raised position to facilitate folding the adjustable bed base. To change the length of the leg assembly, a hollow leg is moved inside a hollow receiver and fixed in place by a first push pin assembly. A second push pin assembly inside the hollow receiver fixes the leg assembly in a lowered position and a raised position for storage or shipment. Each hollow receiver is pivotally secured to a mounting bracket welded to a foldable frame of the adjustable bed base.

19 Claims, 16 Drawing Sheets

(56) References Cited

U.S. PATENT DOCUMENTS

| | | | | |
|---|---|---|---|---|
| 2016/0353898 | A1* | 12/2016 | Petzold | A47C 19/02 |
| 2017/0325592 | A1* | 11/2017 | Suh | A47C 31/00 |
| 2019/0137030 | A1* | 5/2019 | Freelend | A47B 91/024 |
| 2020/0054145 | A1* | 2/2020 | Shih | A47C 23/005 |

* cited by examiner

FOLDABLE ADJUSTABLE BED BASE WITH LEG ASSEMBLIES HAVING ADJUSTABLE LENGTHS

FIELD OF THE INVENTION

This invention relates generally to bedding products and, more particularly, to an adjustable bed base having leg assemblies which may be collapsed for shipping.

BACKGROUND OF THE INVENTION

Conventional adjustable bed bases often have a rectangular frame to which leg assemblies must be secured. Such adjustable bed bases are typically manufactured and shipped to various retail outlets in pieces for offering to end consumers.

Accordingly, manufacturers attempt to package the adjustable bed bases in an efficient and cost-effective manner. This often requires that various components of the adjustable bed bases be packaged in an unassembled state such that subsequent assembly is required before the consumer may use the adjustable bed base. By way of example, the support legs may not come assembled to the adjustable bed base. As a result, the practice of shipping such components separately, in an unassembled state, involves considerable amounts of time and cost for both the manufacturer and end-user.

Conventional assembly of an adjustable bed base often requires hardware and tools, such as wrenches, screw drivers, etc. Accordingly, proper assembly relies on the retailer or consumer having the proper tools readily accessible. It can be frustrating when the person starts assembling the adjustable bed base but then learns that they lack the proper tools required to complete the assembly. Moreover, proper assembly of the adjustable bed base may be dependent on the skill set of the person performing the assembly. Thus, even with the correct tools, proper assembly of the adjustable bed base may not be achieved. The improper assembly of the adjustable bed base may frustrate the customer and result in negative product perception, phone calls or other communications from unsatisfied consumers, or product return and a demand for a refund.

In view of the above, there is an increasing need for manufacturers to provide bedding or furniture products that are easy to assemble and require a minimum number of tools.

It is therefore an objective of this invention to provide an adjustable bed base which may be shipped in a folded state with the leg assemblies pre-attached to the adjustable bed base and configured to be assembled in a tool-less manner.

It is further an objective of this invention to provide an adjustable bed base having leg assemblies, where each leg assembly is foldable between a folded position for shipping and storage and a locked lowered position for use.

It is therefore an objective of this invention to provide an adjustable bed base which may be shipped in a smaller package than previously known with the leg assemblies pre-attached to the adjustable bed base and configured to be shipped inside the frame of the adjustable bed base.

SUMMARY OF THE INVENTION

According to one aspect of the invention, a foldable adjustable bed base comprises a generally rectangular foldable frame. In one embodiment the adjustable bed base is foldable in half. An articulated deck is secured to the generally rectangular foldable frame. The articulated deck comprises multiple deck pieces hinged together. In one embodiment, the articulated deck comprises four deck pieces. Linear actuators are secured to the generally rectangular foldable frame for moving the deck pieces. Mounting brackets are secured to the generally rectangular foldable frame. Each of the mounting brackets is generally U-shaped and has aligned openings for receiving a fastener. The fastener defines a pivot axis for the leg assembly which pivots about the pivot axis inside mounting bracket sides.

Leg assemblies are pivotally secured to the mounting brackets. Each of the leg assemblies has an adjustable length and is pivotal between a raised position for storage or shipment and a lowered position for use. Each of the leg assemblies comprises a hollow receiver pivotally secured to one of the mounting brackets. The hollow receiver has upper openings and aligned lower openings. A first push pin assembly is welded inside the hollow receiver. The first push pin assembly includes a first push pin and a generally C-shaped spring. The first push pin extends through one of the upper openings in the hollow receiver at all times. A hollow leg is sized to fit inside the hollow receiver. The hollow leg has an opening extending through a wall of the hollow leg. The leg assembly further comprises an end cap secured inside the hollow leg.

The leg assembly further comprises a second push pin assembly welded inside the hollow leg. The second push pin assembly includes a second push pin extending through the opening in the hollow leg and through one of the lower openings in the hollow receiver to fix the length of the leg assembly. The first push pin extends through an opening in the mounting bracket when the leg assembly is in its lowered position and fits inside another portion of the mounting bracket when the leg assembly is in its raised position.

In a second aspect, the foldable adjustable bed base comprises a frame foldable in half due to hinges in the frame. An articulated deck is secured to the frame. The articulated deck comprises multiple deck pieces hinged together. In one embodiment, the articulated deck comprises four deck pieces. Motorized linear actuators are secured to the frame for moving the deck pieces.

Mounting brackets are secured to the generally rectangular frame. Each of the mounting brackets is generally U-shaped and has aligned holes for receiving a fastener. The fastener defines a pivot axis for the leg assembly which pivots about the pivot axis inside mounting bracket sides.

A leg assembly is pivotally secured to each of the mounting brackets. Each of the leg assemblies has an adjustable length and is pivotal between a raised position for storage or shipment and a lowered position for use. Each of the leg assemblies comprises a hollow receiver pivotally secured to one of the mounting brackets. The hollow receiver has upper openings and a column of lower openings. The upper openings of the hollow receiver are aligned with the holes in the mounting bracket. A fastener extends through the aligned holes in the mounting bracket and upper openings in the hollow receiver. The fastener defines a pivot axis for the leg assembly relative to the stationary mounting bracket.

A first push pin assembly is welded inside the hollow receiver. The first push pin assembly includes a first push pin and a generally C-shaped spring. The first push pin extends through one of the upper openings in the hollow receiver. A hollow leg is sized to fit inside the hollow receiver. The hollow leg has an opening extending through a wall of the hollow leg. The leg assembly further comprises an end cap secured inside the hollow leg.

The leg assembly further comprises a second push pin assembly welded inside the hollow leg. The second push pin assembly includes a second push pin extending through the opening in the hollow leg and through one of the lower openings in the hollow receiver to fix the length of the leg assembly. The first push pin extends through an opening in the mounting bracket when the leg assembly is in its lowered position and fits inside another portion of the mounting bracket when the leg assembly is in its raised position.

In a third aspect, an adjustable bed base is foldable in half and comprises a foldable frame. An articulated deck is secured to the foldable frame. The articulated deck comprises multiple deck pieces hinged together. Linear actuators move the deck pieces relative to each other.

Mounting brackets are secured to the foldable frame. Each of the mounting brackets is generally U-shaped and has aligned openings for receiving a fastener and a lock opening. The fastener defines a pivot axis for the leg assembly which pivots about the pivot axis inside mounting bracket sides.

A leg assembly is pivotally secured to each of the mounting brackets. Each of the leg assemblies has an adjustable length and is pivotal between a raised position and a lowered position. Each of the leg assemblies comprises a tubular receiver pivotally secured to one of the mounting brackets. The tubular receiver has upper openings and a column of lower openings. The upper openings of the tubular receiver are aligned with the holes in the mounting bracket. A fastener extends through the aligned holes in the mounting bracket and upper openings in the tubular receiver. The fastener defines a pivot axis for the leg assembly relative to the stationary mounting bracket.

A first push pin assembly is welded inside the tubular receiver. The first push pin assembly includes a first push pin and a generally C-shaped spring. The first push pin extends through one of the upper openings in the tubular receiver. A tubular leg is sized to fit inside the tubular receiver. The tubular leg has an opening extending through a wall of the tubular leg. The leg assembly further comprises an end cap secured inside the tubular leg.

The leg assembly further comprises a second push pin assembly welded inside the tubular leg. The second push pin assembly includes a second push pin extending through the opening in the tubular leg and through one of the lower openings in the tubular receiver to fix the length of the leg assembly. The first push pin extends through an opening in the mounting bracket when the leg assembly is in its lowered position and fits inside another portion of the mounting bracket when the leg assembly is in its raised position.

The accompanying drawings, which are incorporated in and constitute a part of this specification, illustrate embodiments of the invention and, together with the summary of the invention given above, and the detailed description of the drawings given below, explain the principles of the present invention.

DETAILED DESCRIPTION OF THE INVENTION

Figure 1:
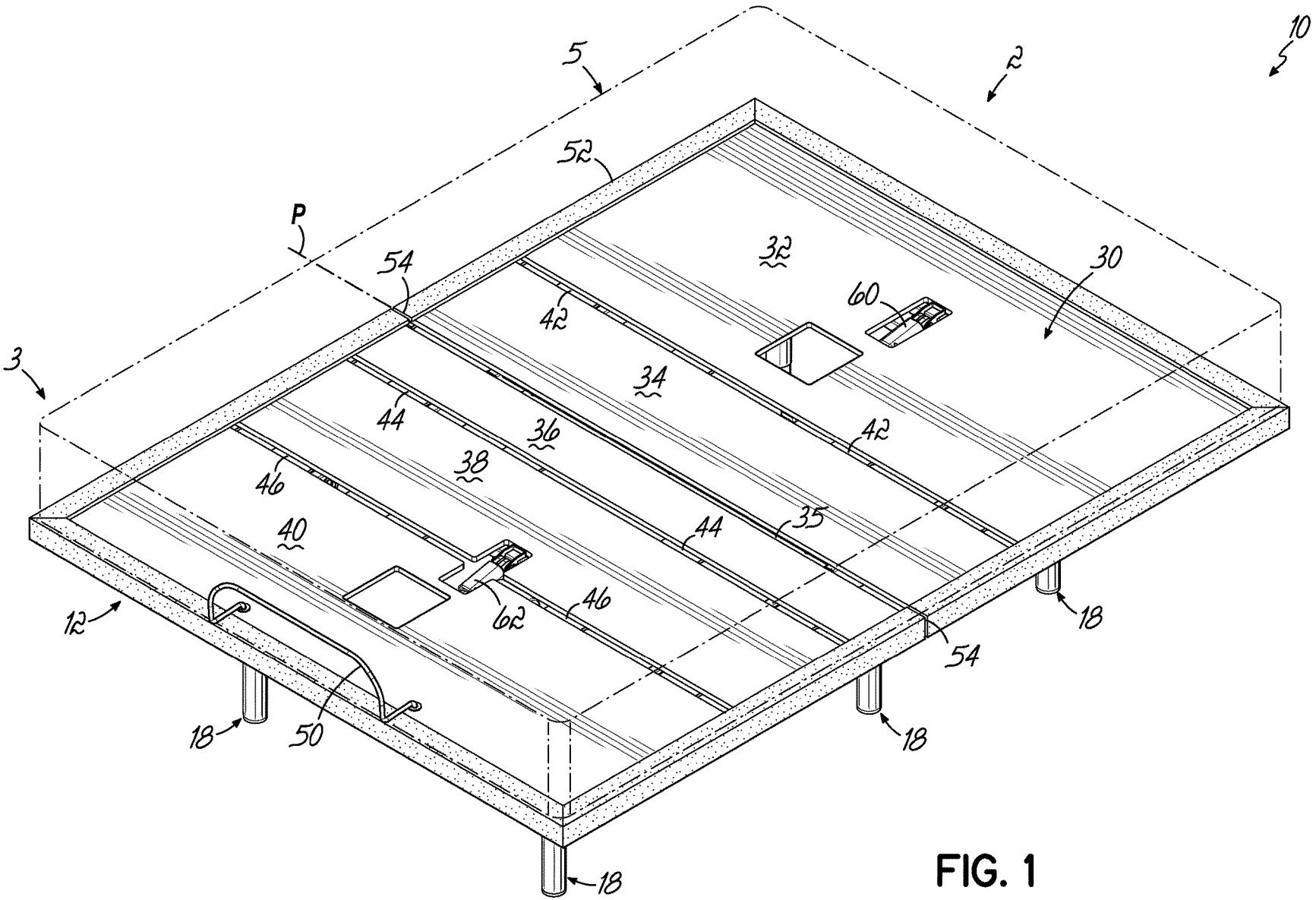
FIG. 1 is a top perspective view of an adjustable bed base.

Referring to FIG. 1, an adjustable bed 10 has a head end 2 and a foot end 3. The adjustable bed 10 includes an adjustable bed base 12 for supporting a mattress 5. The adjustable bed base 12 of the present invention may be used with any type of mattress. The mattress is not intended to be limited by the drawings.

Figure 2:
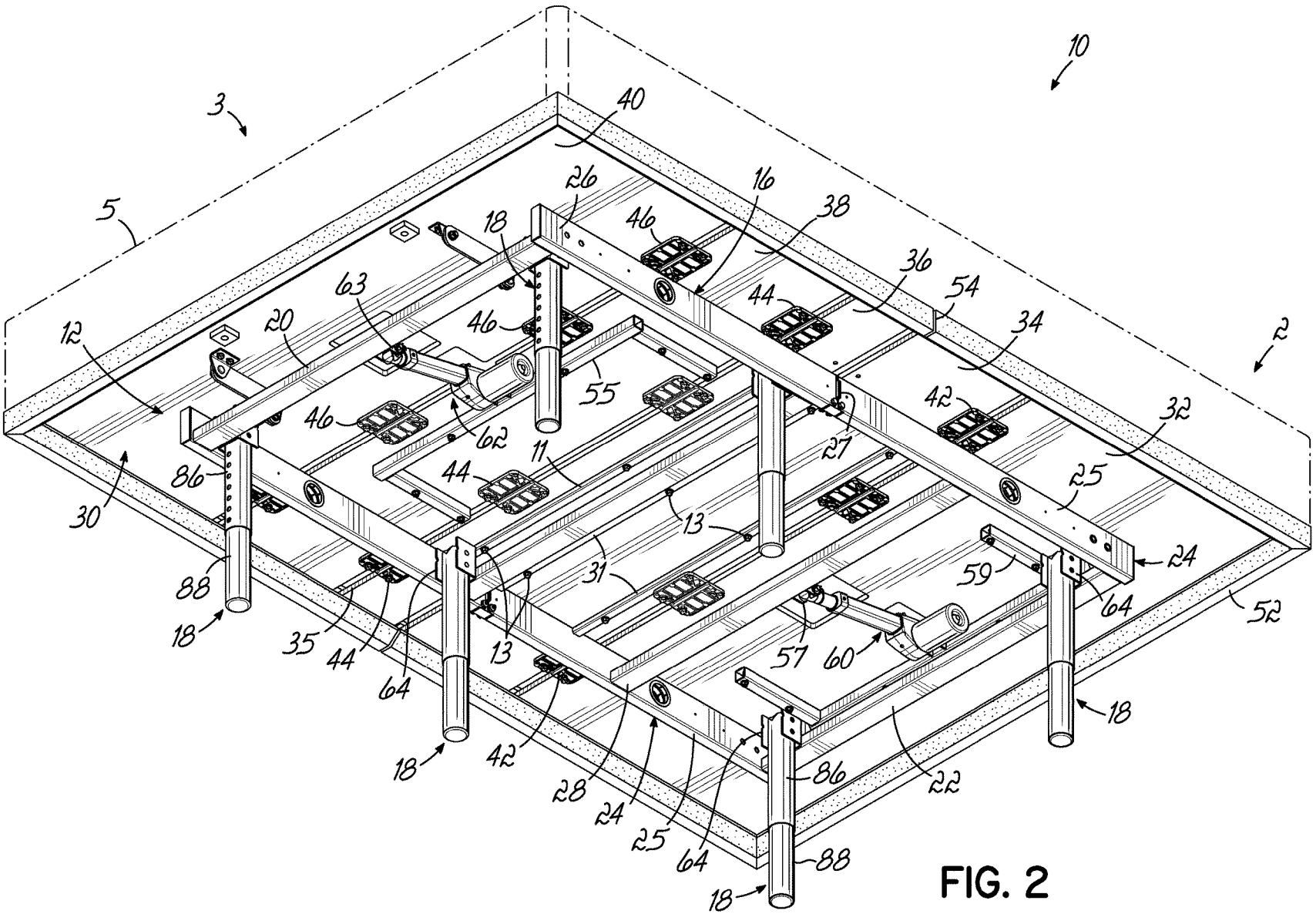
FIG. 2 is a bottom perspective view of the adjustable bed base of FIG. 1 showing a frame supported by six leg assemblies.

As best shown in FIG. 2, the adjustable bed base 12 comprises a generally rectangular metal frame 16 supported by six leg assemblies 18. Although one type of generally rectangular metal frame 16 is illustrated being part of the adjustable bed base 12, any other type of generally rectangular frame may be supported by any number of leg assemblies constructed in accordance with the present invention. The adjustable bed base is not intended to be limited by the drawings.

As best shown in FIG. 2, the generally rectangular foldable metal frame 16 comprises a head member 22, a foot member 20 and two side members 24, each side member 24 extending between the head and foot members 22, 20, respectively. As best shown in FIG. 2, each side member 24 of the generally rectangular metal frame 16 comprises a front side member 25 and a rear side member 26 hinged together with a hinge 27. The generally rectangular metal frame 16 is movable between an extended position shown in FIGS. 1 and 2 and a folded or collapsed position shown in FIG. 7 for shipping or storage. The capability of the generally rectangular metal frame 16 to fold in half enables the adjustable bed base 12 to be shipped in a compact condition, resulting in a cost savings. As best shown in FIG. 2, the generally rectangular metal frame 16 further comprises a hollow cross member 28 extending between the front side members 25. Although each of the frame members 20, 22, 24, 25, 26 and 28 is illustrated as having a hollow interior, one or more frame members may have a filled interior or partially filled interior.

Figure 3:
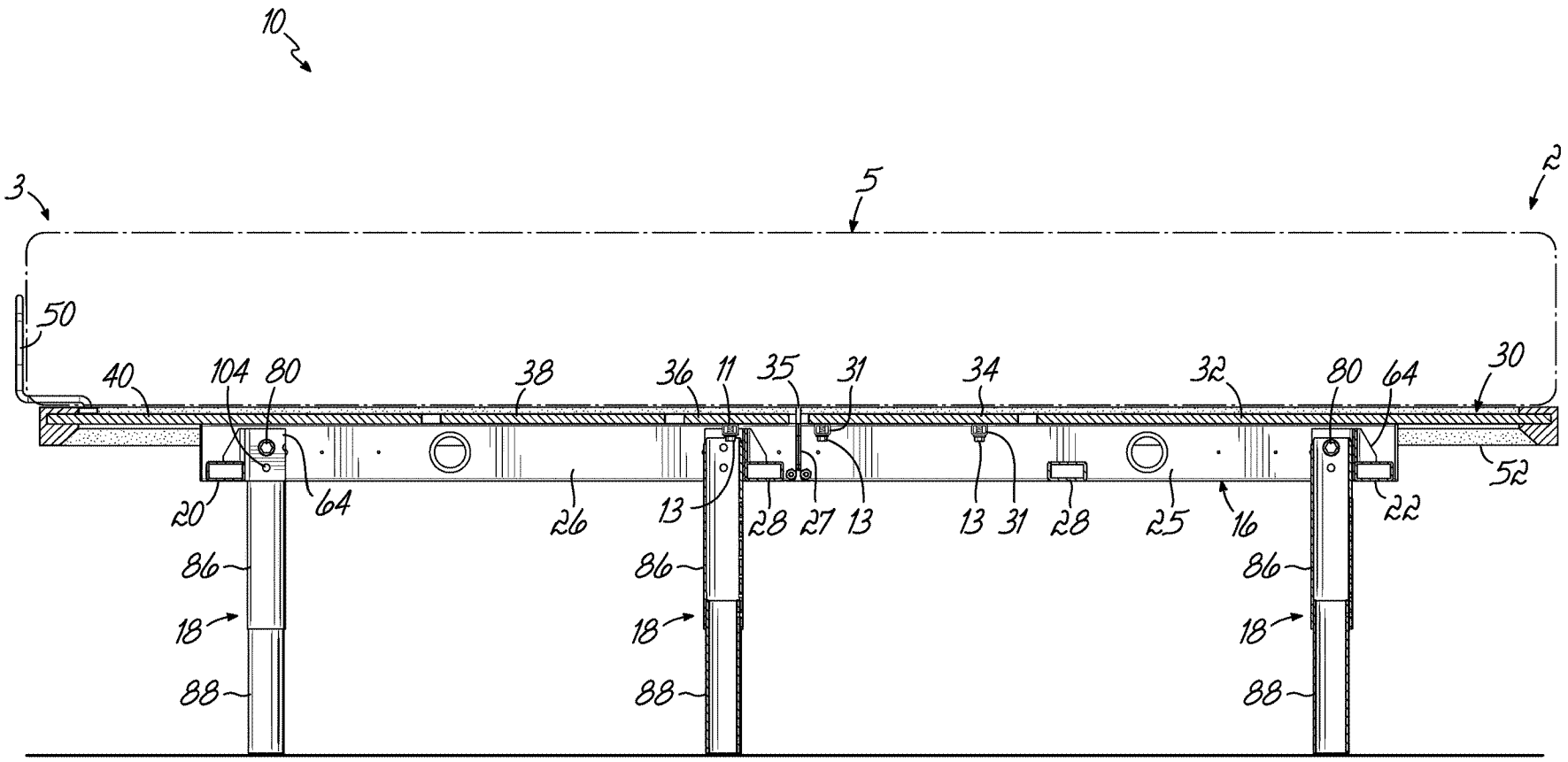
FIG. 3 is a side elevational view of the adjustable bed base of FIG. 2.

As best shown in FIGS. 1 and 2, the adjustable bed base 12 further comprises an articulated deck 30 comprising a head deck board 32 hinged to a front seat deck board 34 with hinges 42. As best shown in FIGS. 2 and 3, the front seat deck board 34 is secured to a cross member 11 of the generally rectangular frame 16 with fasteners 13 and does not move when the deck 30 is articulated. The front seat deck board 34 is spaced from a rear seat deck board 36 with gap 35, as best shown in FIG. 1. The gap 35 is aligned with a gap 54 in foam border 52 as described below and defines a pivot axis P of the adjustable bed base 12. The rear seat deck board 36 is secured to additional cross members 31 of the generally rectangular frame 16 with fasteners 13 and does not move when the deck 30 is articulated. A leg deck board 38 is hinged to the rear seat deck board 36 with hinges 44. Lastly, a foot deck board 40 is hinged to the leg deck board 38 with hinges 46.

As best shown in FIG. 1, a stop 50 is secured to the foot deck board 40 of the deck 30 and functions to prevent movement of the mattress 5 relative to the adjustable bed base 12 when the deck 30 is articulated.

Figure 7:
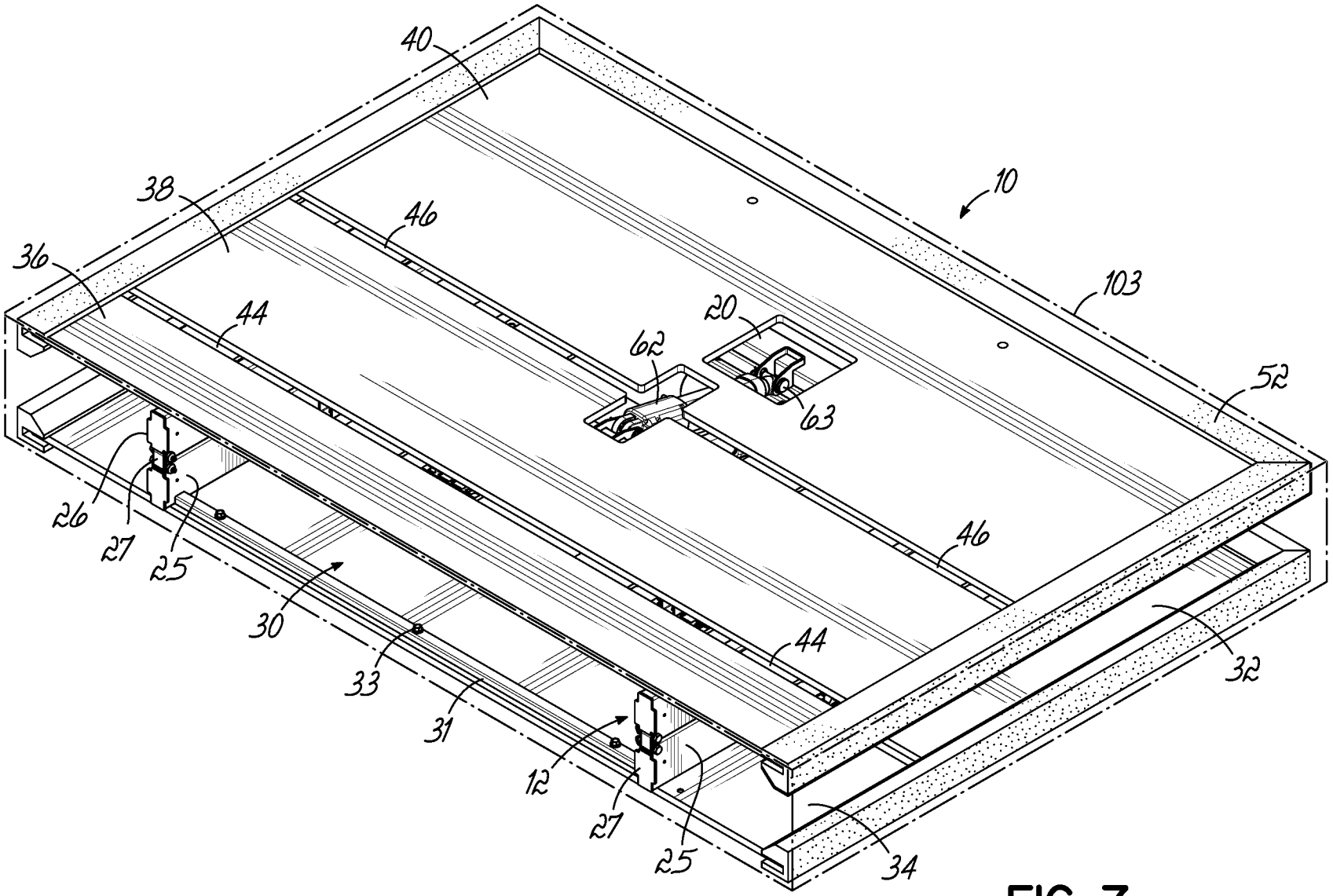
FIG. 7 is a perspective view of the adjustable bed base of FIG. 1 in a collapsed or folded position for shipment.

The adjustable bed base 12 further comprises a foam border 52 extending around the perimeter of the deck 30 for preventing injury to users. The foam border 52 may comprise any number of foam pieces glued together. Regardless of how many pieces are glued together, each side of the foam border 52 has a gap 54 which facilitates the folding of the adjustable bed base 12 in half, as best shown in FIG. 7.

As best shown in FIG. 2, the adjustable bed base 12 further comprises two motorized linear actuators 60, 62. The first motorized linear actuator 60 located proximate the head end 2 of the adjustable bed 10 extends between a bracket 57 secured to the hollow cross member 28 of the frame 16 and a U-shaped metal brace 59 secured to the underside of the head deck board 32. The first motorized linear actuator 60 is used to include the head deck board 32. As best shown in FIG. 2, the second motorized linear actuator 62 extends between a bracket 63 secured to the hollow end member 20 of the frame 16 and a U-shaped brace 55 secured to the underside of the foot deck board 40. The second motorized linear actuator 62 is used to incline the leg deck board 38 and foot deck board 40.

Figure 4A:
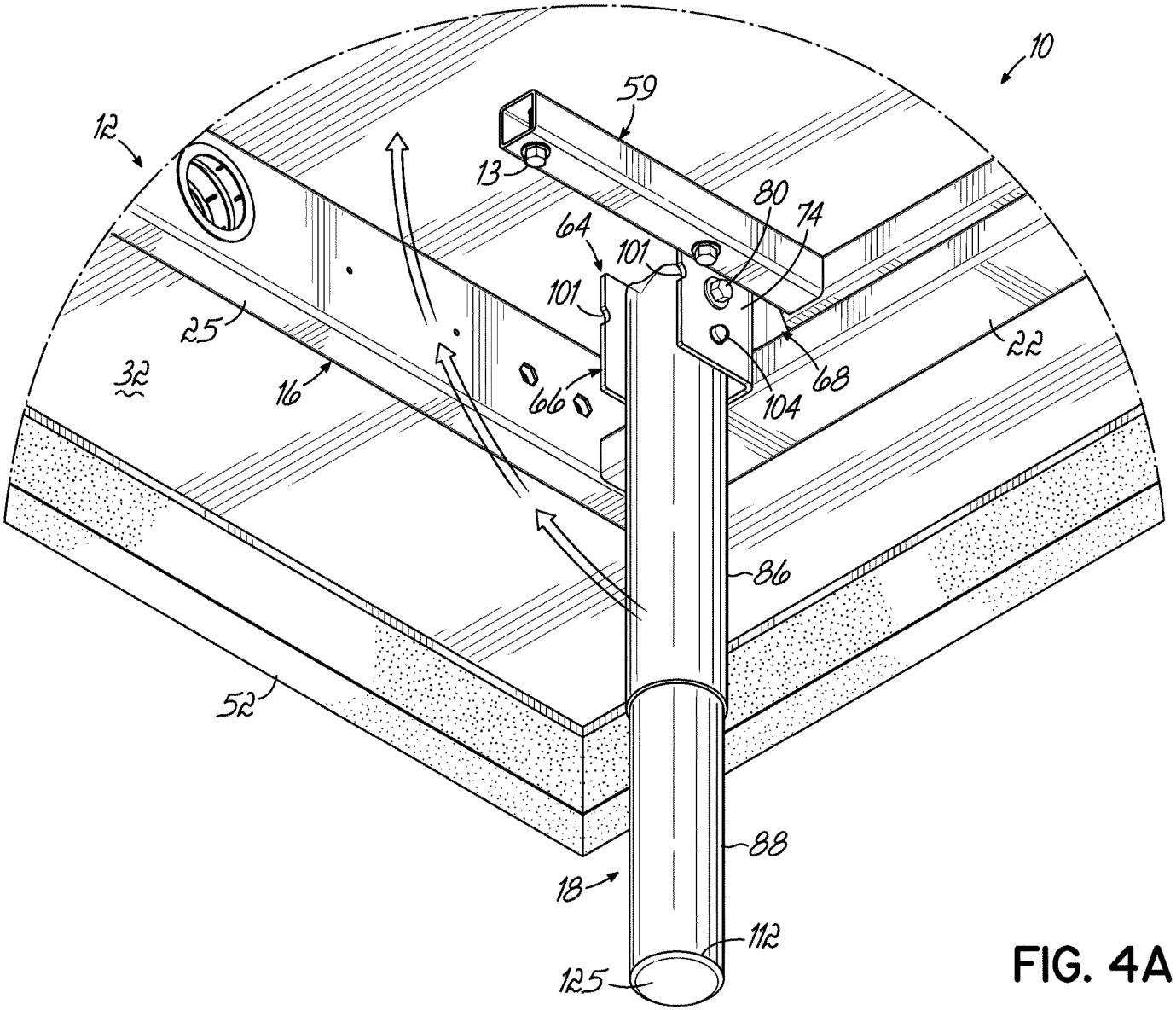
FIG. 4A is a perspective view of one of the leg assemblies secured in a lowered position.
Figure 4B:
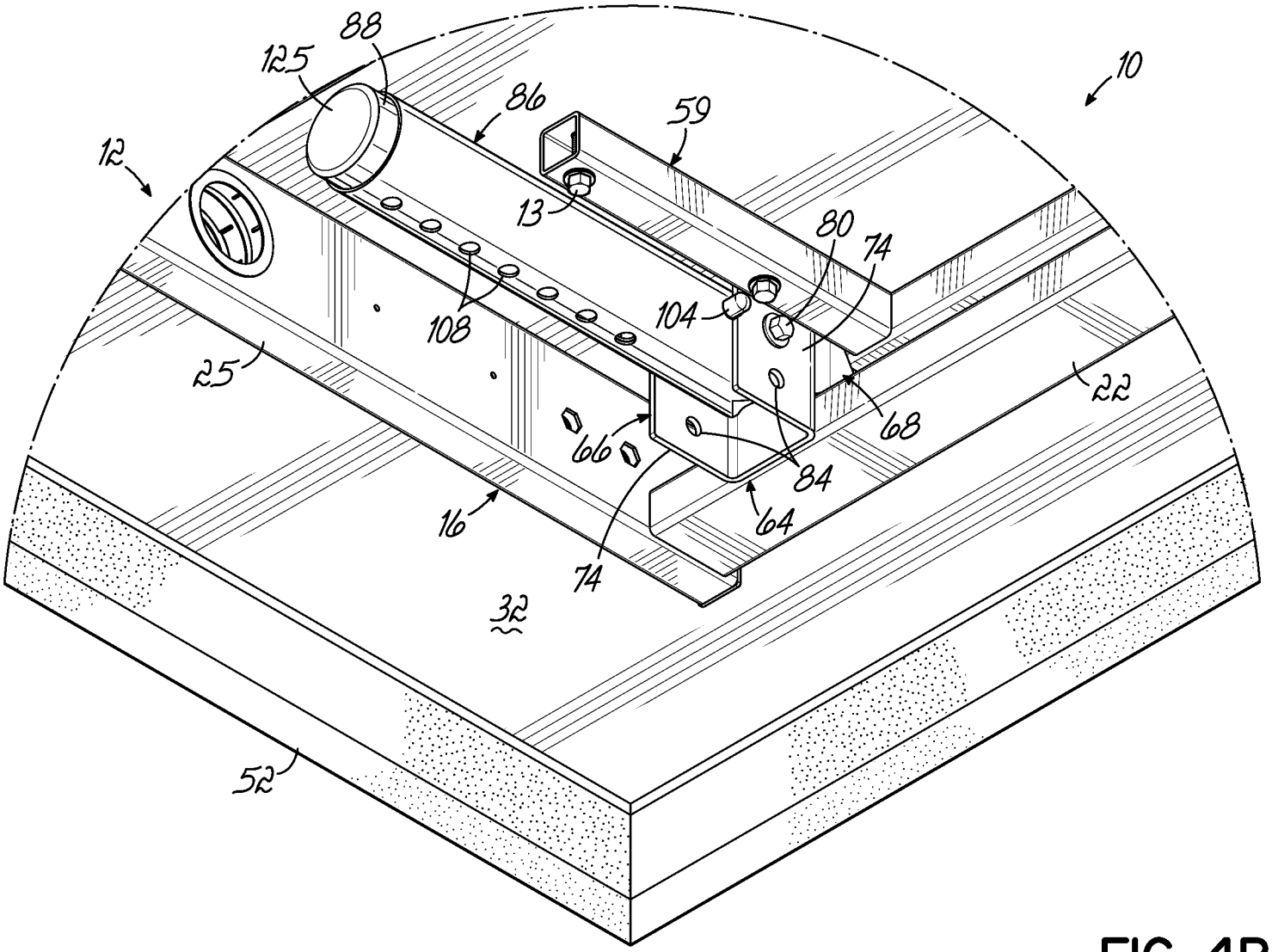
FIG. 4B is a perspective view of the leg assembly of FIG. 4A secured in a raised stored position.

As best shown in FIG. 2, the adjustable bed base 12 further comprises six mounting brackets 64. As best shown in FIGS. 4A and 4B, two of the six mounting brackets 64 are welded to the head member 22 of the generally rectangular metal frame 16. As shown in FIG. 2, two other mounting brackets 64 are welded to the rear member 20 of the generally rectangular metal frame 16. The remaining two mounting brackets 64 are welded to the rear side members 26 of the generally rectangular metal frame 16. Each of the mounting brackets 64 remains stationary regardless of the position of the articulated deck 30 and regardless of the whether the adjustable bed base 12 is in its extended position shown in FIGS. 1 and 2 or folded position shown in FIG. 7.

Figure 6:
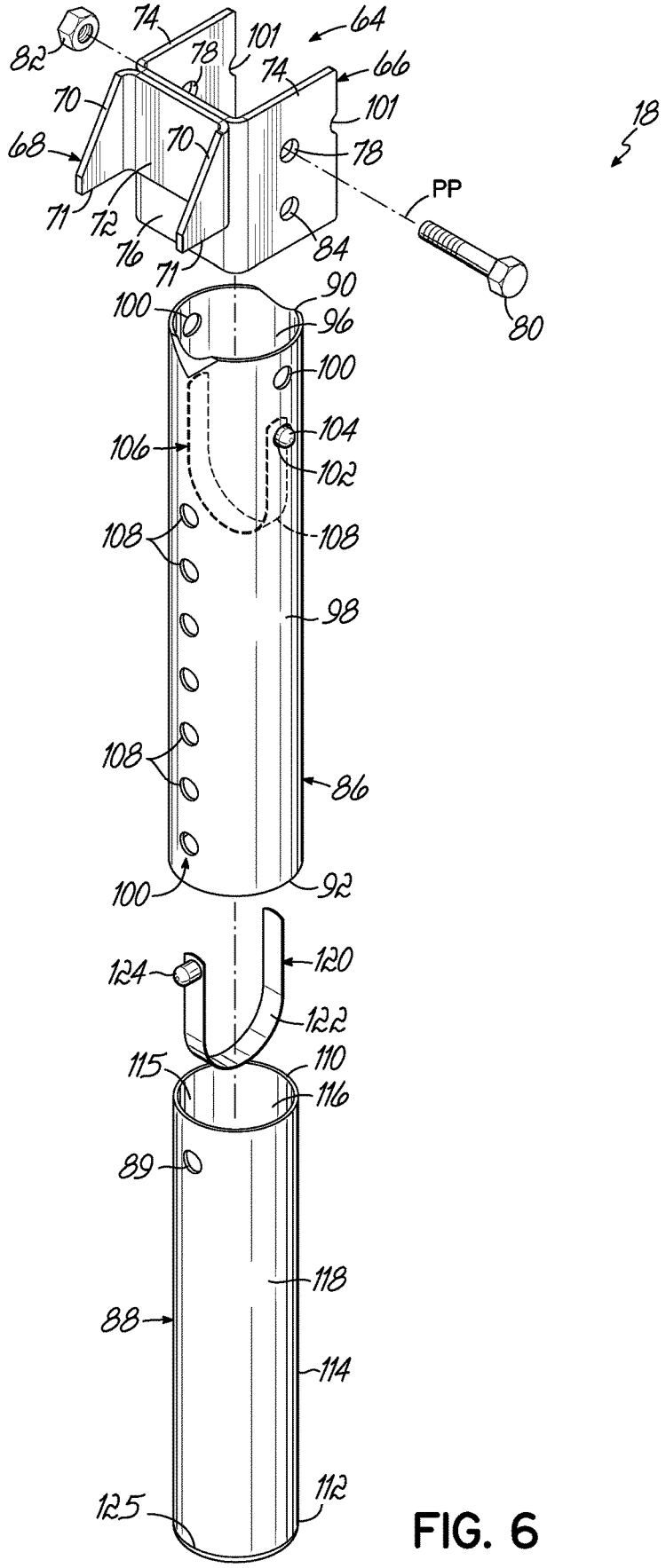
FIG. 6 is a partially disassembled view of one of the leg assemblies.

As best shown in FIGS. 4A, 4B and 6, each mounting bracket 64 is a unitary metal member comprising a generally U-shaped main portion 66 welded to a generally U-shaped support portion 68. As best shown in FIG. 6, the generally U-shaped support portion 68 comprises two triangular side portions 70 extending outwardly from a generally planar rear portion 72. As best shown in FIG. 6, the generally U-shaped main portion 66 comprises two rectangular side portions 74 extending outwardly from a generally planar rear portion 76.

As best shown in FIG. 6, each of the triangular side portions 70 of the generally U-shaped support portion 68 has a lower edge 71 which contacts one of the frame members, such as the front frame member 22 as shown in FIG. 4A. Additionally, the portion of the generally planar rear portion 76 of the generally U-shaped main portion 66 of each mounting bracket 64 below the generally U-shaped support portion 68 contacts one of the frame members such as the front frame member 22 as shown in FIG. 4A.

As best shown in FIG. 6, the rectangular side portions 74 of generally U-shaped main portion 66 of each mounting bracket 64 have aligned openings or holes 78, one opening 78 per side portion 74. A fastener 80 in the form of a bolt extends through the openings 78 and is secured with a nut 82. Below each of the openings 78 is an opening 84 adapted to receive a first push pin 104 to lock the leg assembly 18 in a lowered position for use as described below.

As best shown in FIG. 2, each leg assembly 18 is illustrated being secured to one of the mounting brackets 64 using one of the fasteners 80. Such securement is typically accomplished using fasteners, but any known method may be used to secure the tubular receivers 86, as described below, to one or more pieces of the generally rectangular metal frame 16 such as mounting brackets 64.

Figure 5A:
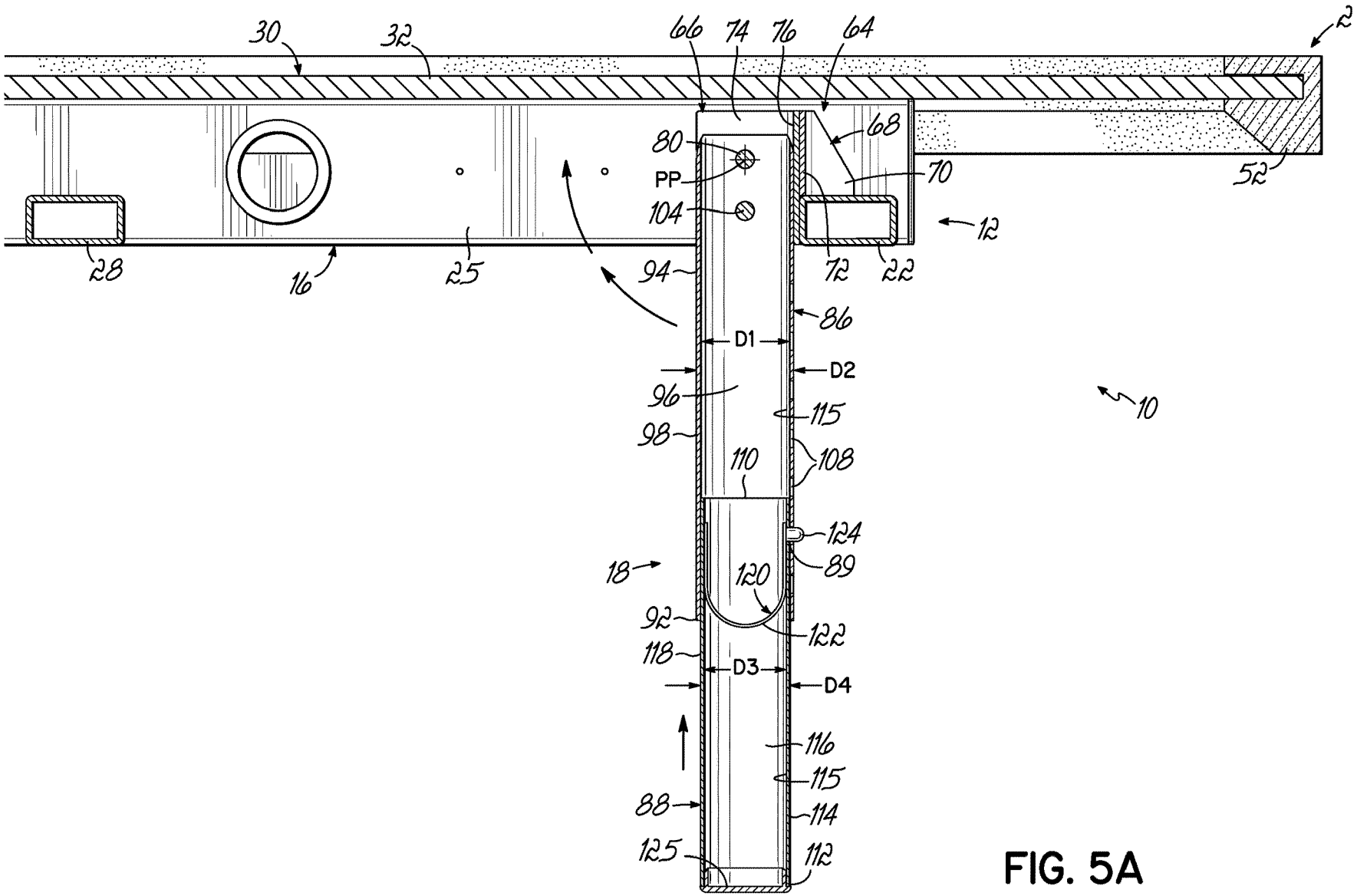
FIG. 5A is an enlarged cross-sectional view of a portion of the adjustable bed base of FIG. 1 showing one of the leg assemblies in a lowered position.

As best shown in FIGS. 5A and 6, each leg assembly 18 has an adjustable length and is pivotal about an axis PP defined by the fastener 80. Each leg assembly 18 is pivotal between a lowered position shown in FIG. 5A and a raised position shown in FIG. 5B. As best shown in FIG. 6, each leg assembly 18 includes a tubular receiver 86 and a tubular leg 88. The tubular leg 18 is moveable relative to the tubular receiver 86 to fix the length of the leg assembly 18.

As best shown in FIG. 6, each leg assembly 18 comprises a tubular receiver 86 having an upper edge 90 and a lower edge 92. As best shown in FIG. 6, tubular receiver 86 comprises a wall 94 having an interior surface defining a hollow interior 96 therein and an exterior surface 98. As shown in FIG. 5A, tubular receiver 86 has an inner diameter D1 and an outer diameter D2. Thus, the tubular receiver 86 has a generally cylindrical shape.

As best shown in FIG. 6, receiver 86 has two aligned upper openings 100 through which the fastener 80 passes. The upper openings 100 of the receiver 86 are adapted to align with the holes 78 of the mounting bracket 64 so the fastener 80 may extend through the two upper openings 100 of the receiver 86 and the two holes 78 of the mounting bracket 64. Once the nut 82 is tightened on the threaded end of the fastener 80, the fastener 80 defines the pivot axis PP about which the leg assembly 18 may pivot relative to the stationary mounting bracket 64.

As best shown in FIG. 6, receiver 86 also has an opening 102 through which a first push pin 104 of a first push assembly 106. The first push assembly 106 includes a generally C-shaped spring 108 having a first push pin 104 welded or secured to one end of the generally C-shaped spring 108. As best shown in FIG. 6, the generally C-shaped spring 108 resides inside the hollow interior 96 of receiver 86, the push pin 104 of first push pin assembly 106 extending through the opening 102 in the receiver 86. When the leg assembly 18 is locked in its lowered position shown in FIG. 4A, the first push pin 104 of first push pin assembly 106 also extends through the opening 84 of mounting bracket 64.

As best shown in FIG. 6, receiver 86 also has seven lower openings 108 aligned in a column 110 extending parallel an axis A of the leg assembly 18. Each lower opening 108 extends through the wall 94 of the receiver 86. Although seven aligned openings 86 are illustrated, the receiver 86 may have any desired number of holes or openings of any desired shape.

Figure 5B:
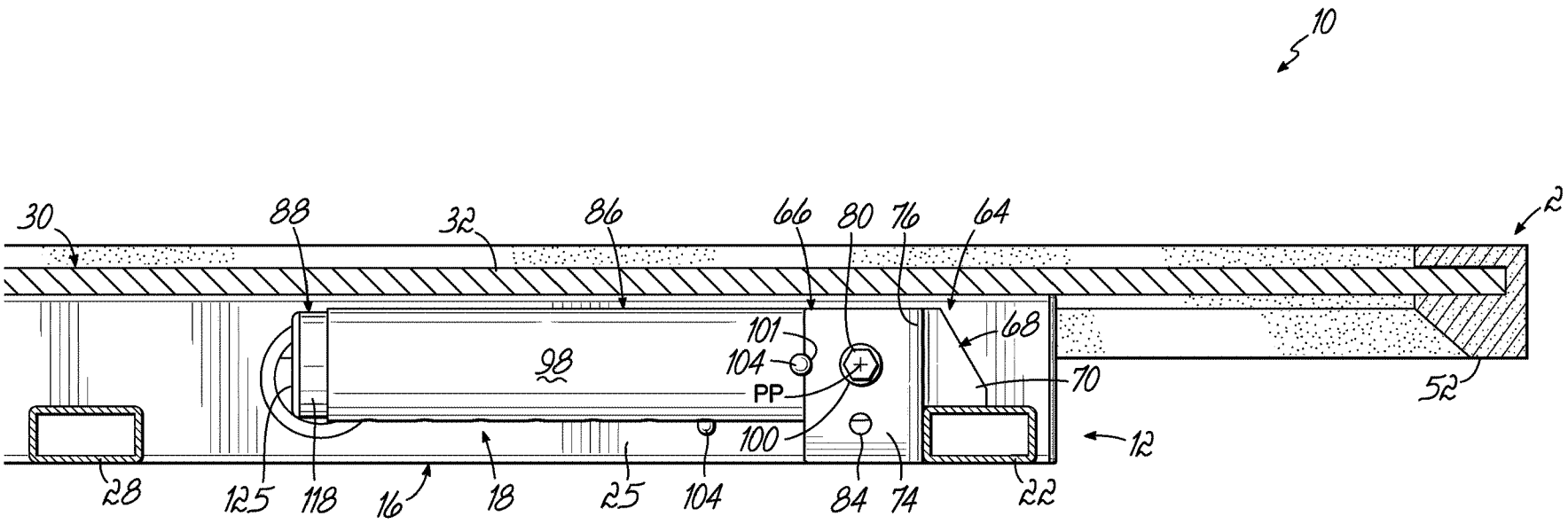
FIG. 5B is an enlarged cross-sectional view showing the portion of the adjustable bed base of FIG. 5A showing the leg assembly secured in a raised position.

Each leg assembly 18 further comprises a tubular leg 88 having an upper edge 110, as best shown in FIG. 6, and a lower edge 112. As best shown in FIGS. 5A and 5B, tubular leg 88 comprises a wall 114 having an interior surface 115 defining a hollow interior 116 therein and an exterior surface 118. As shown in FIG. 5A, tubular leg 88 has an inner diameter D3 and an outer diameter D4. Thus, the tubular leg 88 has a generally cylindrical shape. The tubular leg 88 also has an opening 89 extending through the wall 114 of the tubular leg 88 proximate the upper edge 110 of the tubular leg 88.

As best shown in FIG. 6, each leg assembly 18 further comprises a second push pin assembly 120, including a generally C-shaped spring 122 having a second push pin 124 welded or secured to one end of the generally C-shaped spring 122. As best shown in FIG. 5A, the generally C-shaped spring 122 is secured, preferably via welding, inside the hollow interior 116 of tubular leg 88. The second push pin 124 of second push pin assembly 120 extends through the opening 89 in the tubular leg 88 and through one of the lower openings 108 in the receiver 86 to fix the length of the leg assembly 18. Because the second push pin 124 of second push pin assembly 120 extends through the opening 89 in the tubular leg 88 and though one of the lower openings 108 of tubular receiver 26, the tubular leg 88 is fixed relative to the tubular receiver 86.

As best shown in FIG. 5A, each leg assembly 18 further comprises an end cap 125. The end cap 125 rests inside the hollow interior 116 of the tubular leg 88 at the bottom thereof. Although one type of end cap 125 is shown, any other configuration of end cap 125 may be used.

FIGS. 4A and 5A illustrate one of the leg assemblies 18 locked in a lowered position with the first push pin 104 extending through one of the openings 84 of one of the mounting brackets 64. Depending upon the desired height of the articulated deck 30 of the adjustable bed base, the second push pin 124 extends through one of the lower openings 108 of one of the tubular receiver 86. Preferably, all leg assemblies 18 are adjusted to the same height for use, as shown in FIG. 3.

FIGS. 4B and 5B illustrate the leg assembly 18 locked in a raised position with the first push pin 104 located in a groove 101 of one of the mounting brackets 64. The grooves 101 are formed in the two rectangular side portions 74 of the generally U-shaped main portion 66 of mounting bracket 64, as best shown in FIG. 6. Although not shown, another opening may be formed in the mounting bracket to receive the first push pin 104 to lock the leg assembly 18 in a raised position for storage or shipment.

FIG. 7 shows the adjustable bed base 12 folded in half and enclosed in a box 103 for shipping. The box 103 is shown in dashed lines. The box 103 may be made of cardboard or any other desired known material.

Figure 8:
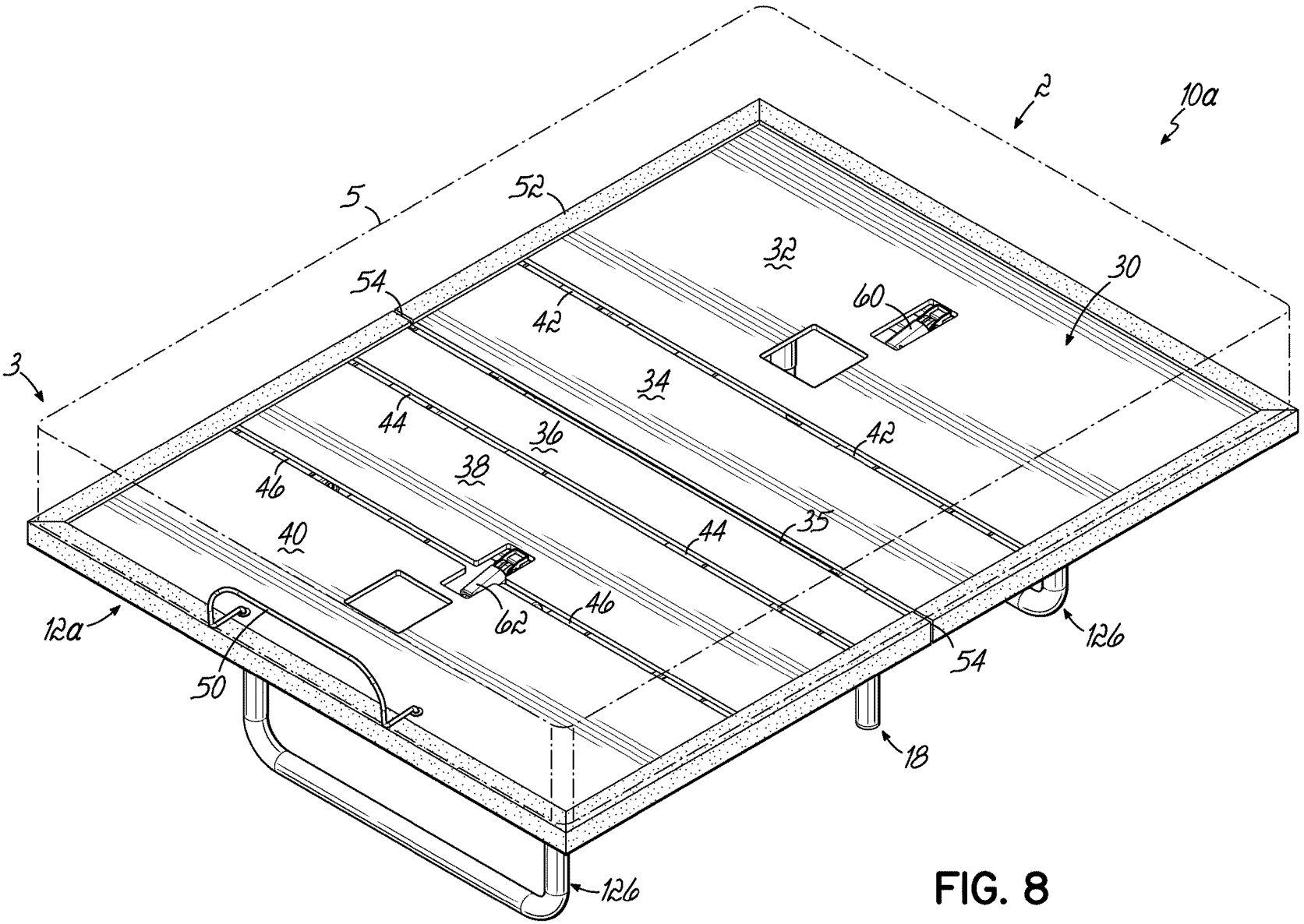
FIG. 8 is a top perspective view of another embodiment of adjustable bed base in a ready to use position.
Figure 9A:
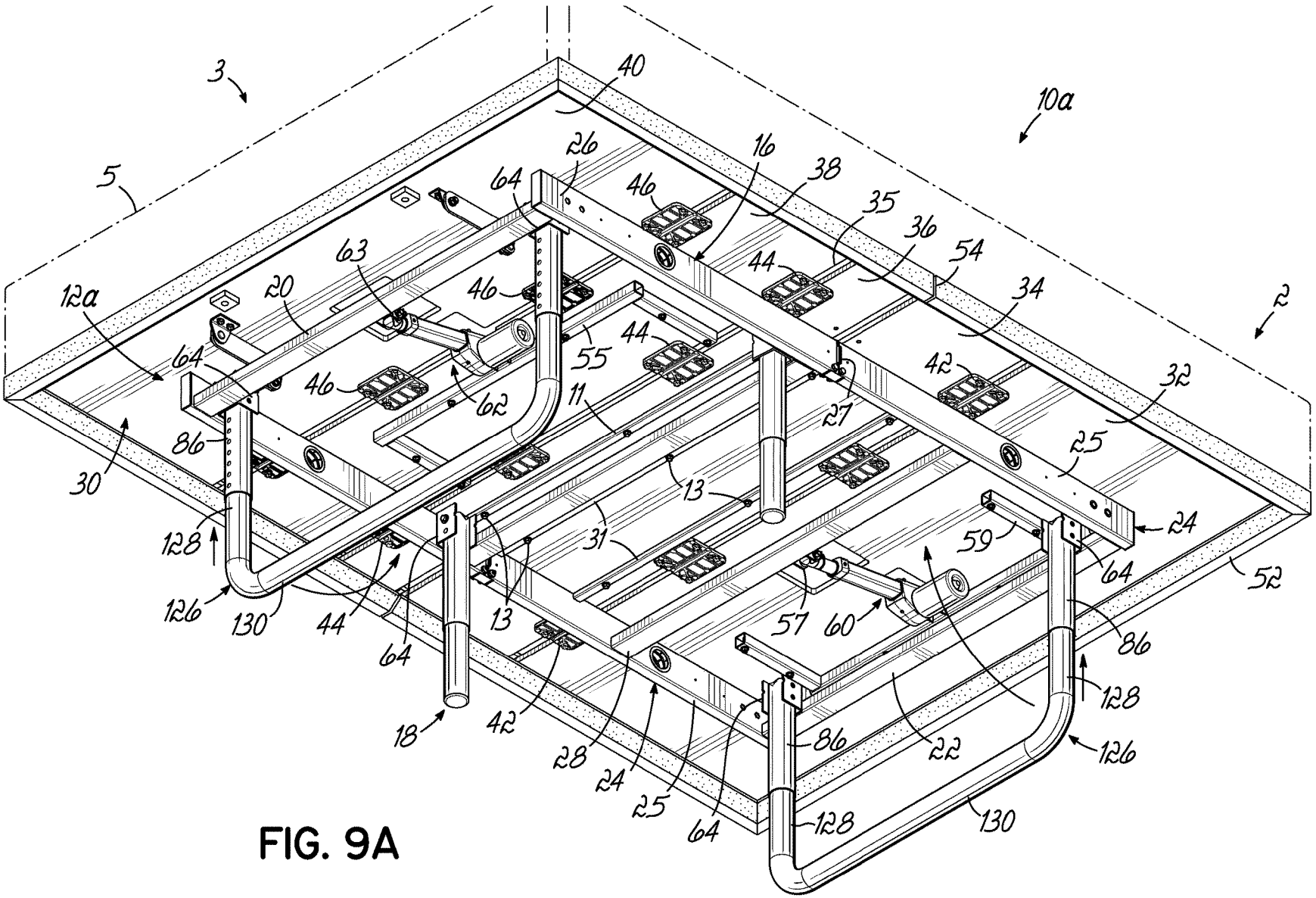
FIG. 9A is a bottom perspective view of the adjustable bed base of FIG. 8 showing a frame supported by front and rear tubular support assemblies and two middle leg assemblies.
Figure 9B:
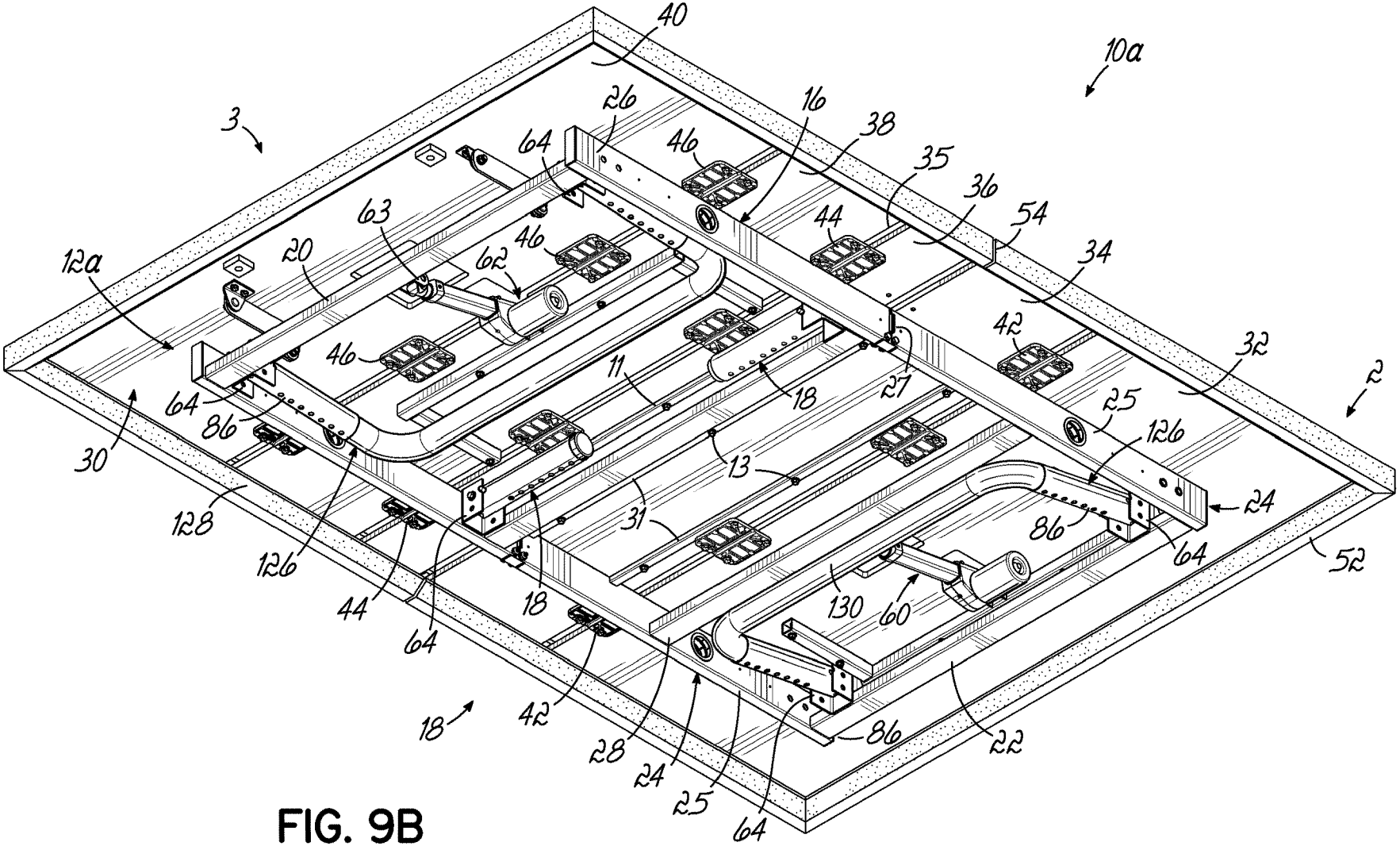
FIG. 9B is a bottom perspective view of the adjustable bed base of FIG. 9 showing the front and rear tubular supports and middle leg assemblies secured in a raised position inside the frame of the adjustable bed base.
Figure 10:
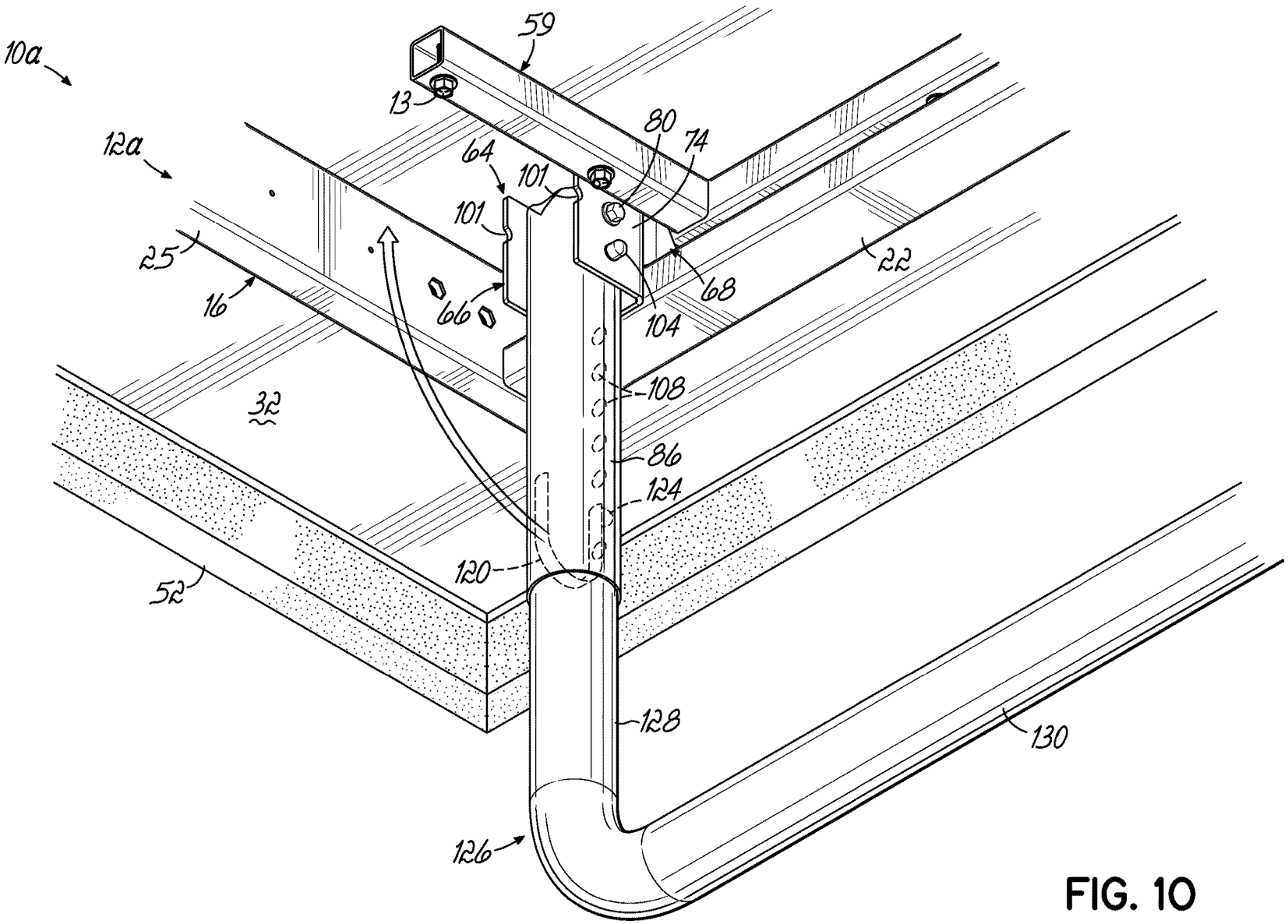
FIG. 10 is an enlarged cross-sectional view of a portion of the adjustable bed base of FIG. 8 showing one of the tubular support assemblies in a down position.

FIGS. 8-10 illustrate another embodiment of adjustable bed base 12*a* utilizing the features of the present invention for use in an adjustable bed 10*a*. For simplicity, like parts are numbered the same. The adjustable bed base 12*a* has the same foldable frame 16 as described above and shown in adjustable bed base 12. The mounting brackets 64 and receivers 86 are identical as those described above and shown in adjustable bed base 12. However, as shown in FIGS. 9A and 9B, the middle leg assemblies 18 are folded inwardly towards each other and may be locked in the positions shown in FIG. 9B. The middle mounting brackets 64 are oriented differently than the middle mounting brackets shown in adjustable bed base 12, thereby enabling the middle two leg assemblies 18 to fold from one side towards the other side as shown in FIG. 9B and remain locked in such positions.

In adjustable bed base 12*a*, in place of tubular legs, a U-shaped support tube 126 is secured with second push pin assemblies 120 inside the corner receivers 86. Each U-shaped support tube 126 has two leg portions 128 and a middle portion 130 therebetween. Each of the leg portions 128 has a second push pin assembly 120 adapted to engage one of the lower openings of one of the corner receivers 86, as described above to fix the height of the U-shaped support tube 126. Each of the U-shaped support tubes 126 is locked in its raised position as shown in FIG. 9B using the same locking mechanism described above with mounting brackets 64 and tubular receivers 86. As best shown in FIG. 10, each of the leg portions 128 of each U-shaped support tube 126 is secured inside one of the tubular receivers 86 with one of the second push pin assemblies 120 as described above and shown herein.

Figure 11A:
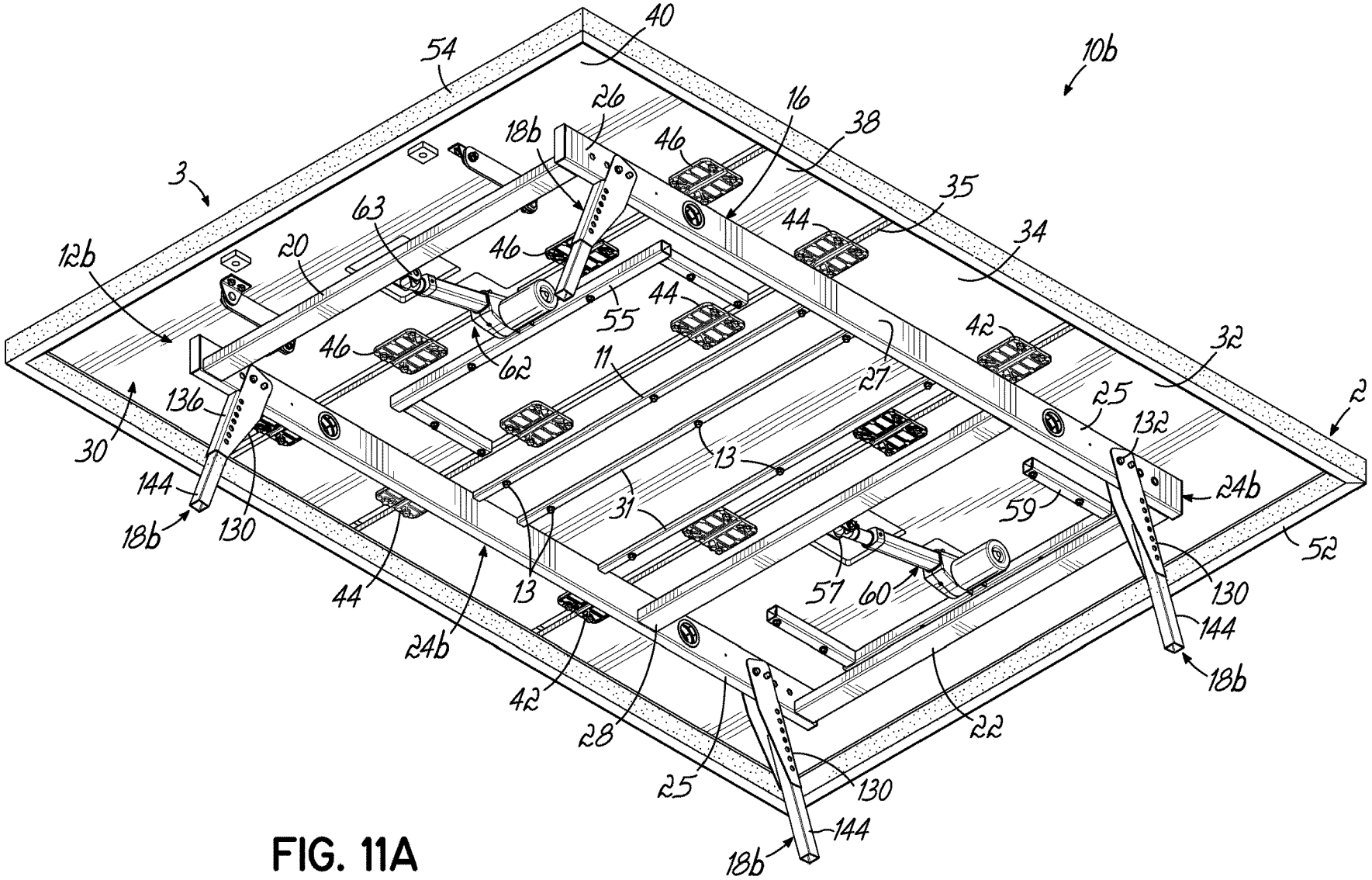
FIG. 11A is a bottom perspective view of another embodiment of adjustable bed base in a ready to use position.
Figure 11B:
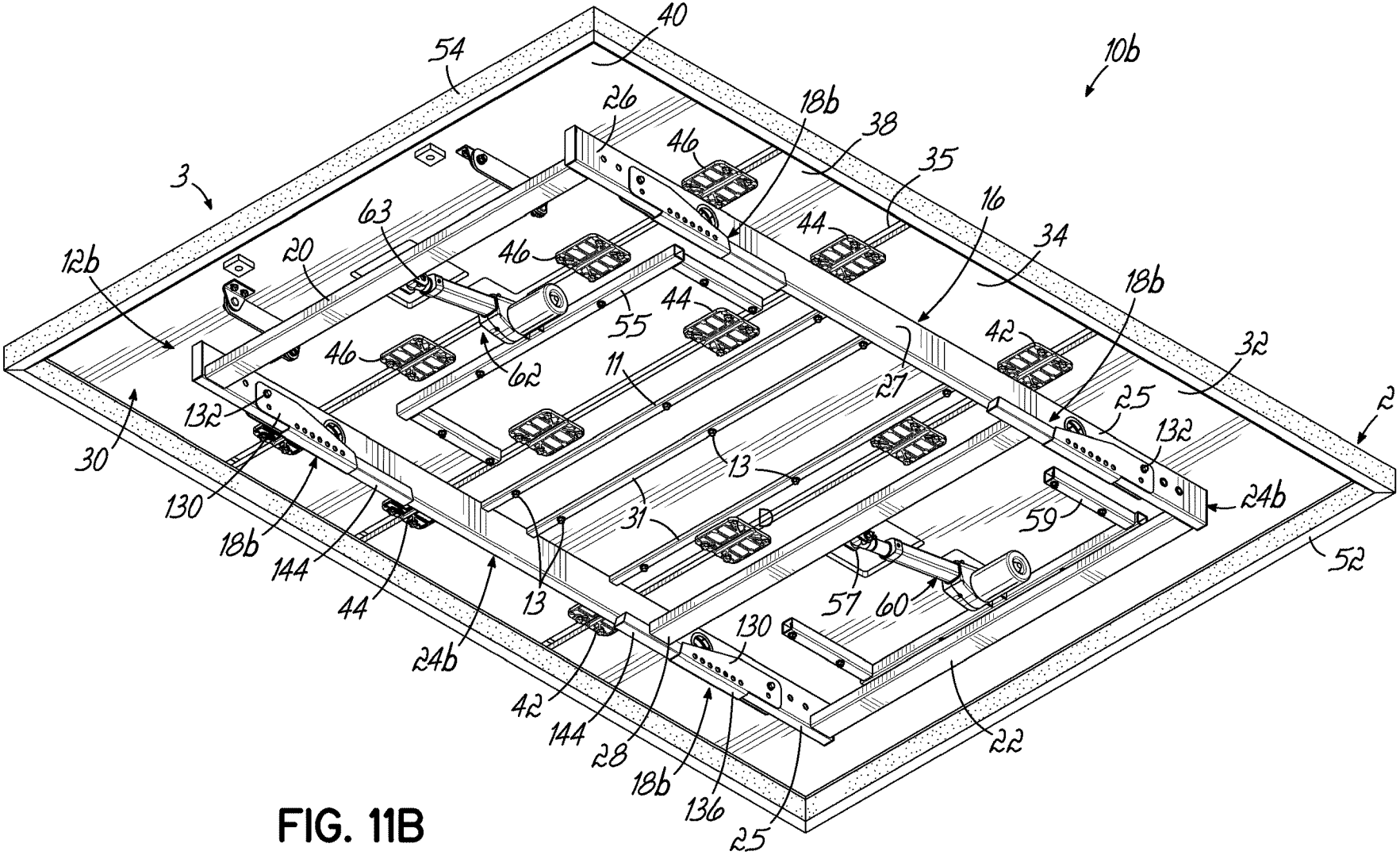
FIG. 11B is a bottom perspective view of the adjustable bed base of FIG. 11A showing the leg assemblies secured in a raised position inside the frame of the adjustable bed base.
Figure 12:
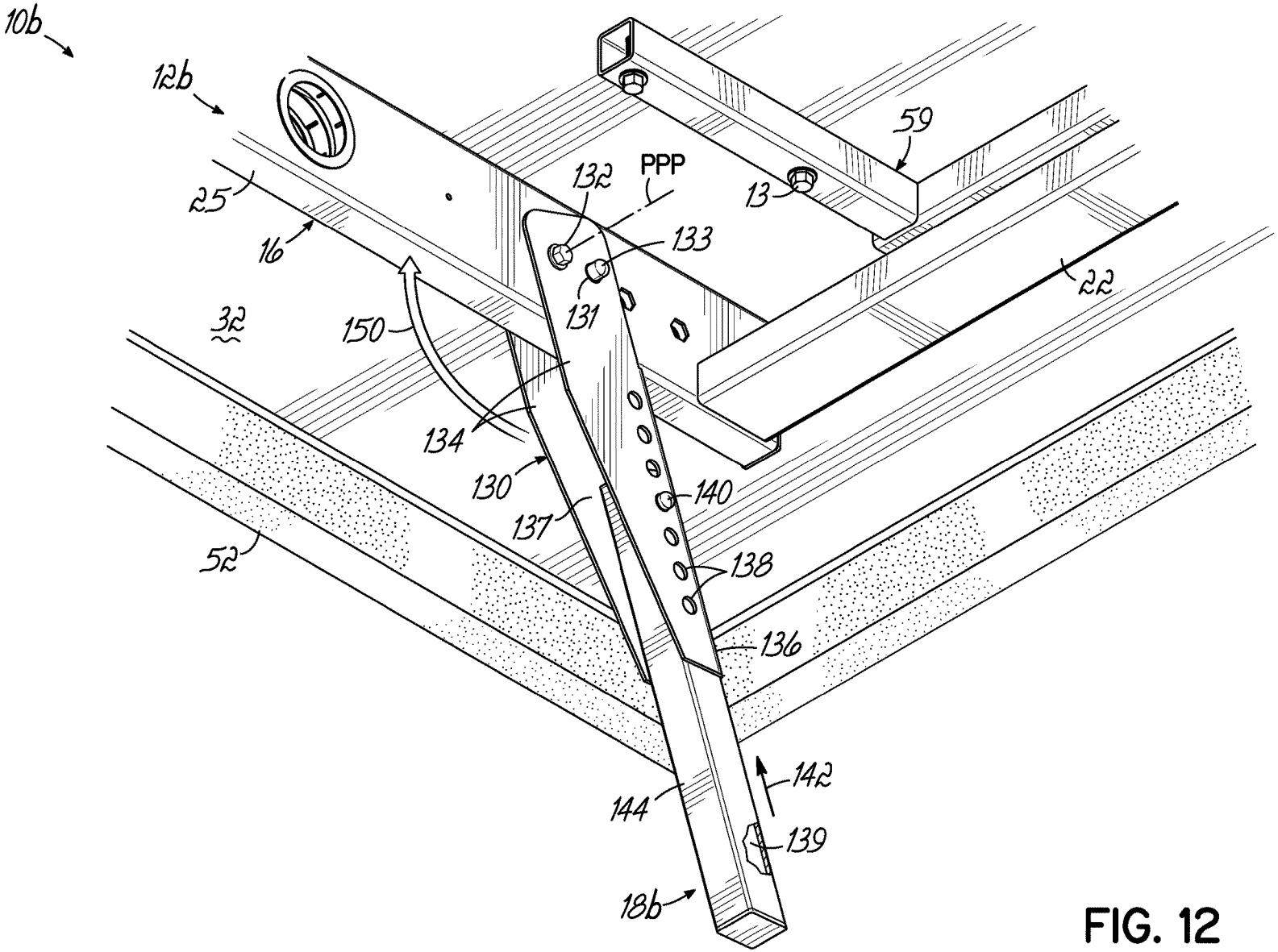
FIG. 12 is an enlarged perspective view of one of the leg assemblies of the adjustable bed base of FIGS. 11A and 11B secured in a lowered position.

FIGS. 11A-12 illustrate another embodiment of adjustable bed 10*b* utilizing the features of the present invention. For simplicity, like parts are numbered the same. The adjustable bed base 12*b* of adjustable bed 10*b* has a non-foldable frame 16*b* lacking the hinges 27 of foldable frame 16 described above and shown in adjustable beds 10 and 10*a*. The non-foldable frame 16*b* comprises a head member 22, a foot member 20 and two side members 24*b*, each side member 24*b* extending between the head and foot members 22, 20, respectively. The head and foot members 22, 20 are identical to those used in the foldable frame 16 described and shown herein. Although the drawings shown a non-foldable frame, this embodiment of adjustable bed base may have a foldable frame. Similarly, each of the adjustable bed bases shown and described herein having a foldable frame may be used with a non-foldable frame.

Adjustable bed base 12*b* has no mounting brackets. The leg assemblies 18*b* differ from leg assemblies 18 described above and shown herein. FIG. 11A shows in the four leg assemblies 18*b* locked in a lowered position. FIG. 11B shows in the four leg assemblies 18*b* locked in a raised position.

As best shown in FIG. 12, each leg assembly 18*b* comprises a receiver 130 pivotally secured to one of the side members 24*b* of the non-foldable frame 16*b* with a fastener 132 and a leg 144. The fastener 132 defines a pivot axis PPP about which the leg assembly 18*b* pivots relative to the side member 24*b* of the non-foldable frame 16*b*. The receiver 130 is generally U-shaped in cross section rather than tubular and comprises two side walls 134 and a connecting wall 136 defining an interior 137. The receiver 130 has an opening 131 extending through at least one of the side walls 134 of receiver 130. A push pin 133 of a push pin assembly as described and shown herein extends through the opening 131 of receiver 130 to fix the receiver in a lowered position for use as shown in FIG. 12. The push pin assembly and accompanying push pin 133 are secured in the side member 24*b* of the non-foldable frame 16*b*. When the push pin 133 is depressed, the receiver 130 may be pivoted about axis PPP to a raised position as shown by the arrow 150 shown in FIG. 12.

At least one of the side walls 134 of receiver 130 has a column of openings 138 adapted to receive a push pin 140 to fix the length of the leg assembly 18*b*, as shown by the arrow 142. The push pin 140 is part of a push pin assembly as described and shown herein, secured inside an interior 139 of the leg 144. When the push pin 140 is depressed, the leg 144 may be raised or lowered to the desired position relative to the receiver 130, as shown by the arrow 142 shown in FIG. 12. The push pin 140 is used to adjust the leg assembly 18*b* to a desired length. The legs 144 of the leg assemblies 18*b* may be removed for shipment or stored in their raised positions as shown in FIG. 11B.

The various embodiments of the invention shown and described are merely for illustrative purposes only, as the drawings and the description are not intended to restrict or limit in any way the scope of the claims. Those skilled in the art will appreciate various changes, modifications, and improvements which can be made to the invention without departing from the spirit or scope thereof. The invention in its broader aspects is therefore not limited to the specific details and representative apparatus and methods shown and described. Departures may therefore be made from such details without departing from the spirit or scope of the general inventive concept. The invention resides in each individual feature described herein, alone, and in all combinations of any and all of those features. Accordingly, the scope of the invention shall be limited only by the following claims and their equivalents.

What is claimed is:

1. A foldable adjustable bed base comprising:

a generally rectangular foldable frame;

an articulated deck secured to the generally rectangular foldable frame, the articulated deck comprising multiple deck boards hinged together;

linear actuators secured to the generally rectangular foldable frame for moving the articulated deck;

mounting brackets secured to the generally rectangular foldable frame, each of the mounting brackets being a generally U-shaped member having two side portions and a main portion, each of the side portions having a groove extending inwardly from an edge thereof;

leg assemblies pivotally secured to the mounting brackets, each of the mounting brackets having aligned openings for receiving a fastener which defines a pivot axis for the leg assembly pivotally secured to the mounting bracket, each of the leg assemblies having an adjustable length being pivotal between a raised position and a lowered position, each of the leg assemblies comprising a hollow receiver pivotally secured to one of the mounting brackets, the hollow receiver having upper openings and aligned lower openings;

a first push pin assembly welded inside the hollow receiver, the first push pin assembly including a first push pin extending through one of the upper openings in the hollow receiver;

a hollow leg sized to fit inside the hollow receiver, the hollow leg having an opening extending through a wall of the hollow leg;

a second push pin assembly welded inside the hollow leg, the second push pin assembly including a second push pin extending through the opening in the hollow leg and through one of the lower openings in the hollow receiver to fix the length of the leg assembly;

wherein the first push pin assembly extends through an opening in the mounting bracket when the leg assembly is in its lowered position and fits inside one of the grooves of the mounting bracket when the leg assembly is in its raised position.

2. The foldable adjustable bed base of claim 1, further comprising a foam border extending around a perimeter of the articulated deck.

3. The foldable adjustable bed base of claim 1, further comprising an end cap secured inside one end of the hollow leg.

4. The foldable adjustable bed base of claim 1, wherein each of the push pin assemblies includes a generally C-shaped spring in addition to the push pin.

5. The foldable adjustable bed base of claim 1, wherein the hollow receiver and hollow leg are cylindrical.

6. The foldable adjustable bed base of claim 1, wherein the foldable adjustable bed base is foldable in half.

7. The foldable adjustable bed base of claim 1, wherein each of the leg assemblies has an end cap.

8. An adjustable bed base foldable in half, the adjustable bed base comprising:

a frame foldable in half, said frame having multiple frame members;

an articulated deck secured to the frame, the articulated deck comprising multiple deck boards hinged together;

motorized linear actuators secured to the frame for moving the articulated deck;

mounting brackets secured to the frame, each of the mounting brackets comprising a U-shaped main portion welded to a U-shaped support portion, the U-shaped main portion having aligned holes and the U-shaped support portion having two triangular side portions extending outwardly from a rear portion, the triangular side portions contacting one of the frame members;

a leg assembly pivotally secured to each of the mounting brackets, the leg assembly being movable between a raised position and a lowered position and having an adjustable length, the leg assembly comprising a hollow receiver pivotally secured to one of the mounting brackets and a hollow leg, the hollow receiver having upper openings and lower openings, the upper openings of the hollow receiver being aligned with the holes in the U-shaped main portion of the mounting bracket;

a fastener extending through the aligned holes in the U-shaped main portion of the mounting bracket and upper openings in the hollow receiver, the fastener defining a pivot axis for the leg assembly relative to the mounting bracket;

a first push pin assembly welded inside the hollow receiver, the first push pin assembly including a first push pin extending through one of the upper openings in the hollow receiver;

a hollow leg sized to fit inside the hollow receiver, the hollow leg having at least one opening extending through a wall of the hollow leg;

a second push pin assembly welded inside the hollow leg, the second push pin assembly including a second push pin extending through the opening in the hollow leg and through one of the lower openings in the hollow receiver to fix the length of the leg assembly;

wherein the first push pin assembly extends through an opening in the U-shaped main portion of the mounting bracket when the leg assembly is in its lowered position and fits inside a groove extending inwardly from an edge of the U-shaped main portion of the U-shaped main portion of the mounting bracket when the leg assembly is in its raised position.

9. The adjustable bed base of claim 8, further comprising an end cap secured inside the hollow leg.

10. The adjustable bed base of claim 9, wherein the frame is generally rectangular.

11. The adjustable bed base of claim 8, wherein the first push pin assembly includes a first generally C-shaped spring and the first push pin, the first push pin being secured to one end of the first C-shaped spring and the second push pin assembly includes a second generally C-shaped spring and the second push pin, the second push pin being secured to one end of the second C-shaped spring.

12. The adjustable bed base of claim 8, wherein the adjustable bed base has six leg assemblies.

13. The adjustable bed base of claim 8, wherein the leg assemblies are inside the frame when the adjustable bed is collapsed.

14. The adjustable bed base of claim 8, wherein the leg assemblies are inside the frame when the leg assemblies are in their raised positions.

15. An adjustable bed base foldable in half, the adjustable bed base comprising:

a foldable frame;

an articulated deck secured to the foldable frame, the articulated deck comprising deck boards hinged together;

linear actuators for moving the articulated deck;

mounting brackets secured to the foldable frame, each of the mounting brackets being a generally U-shaped member having two side portions and a main portion, each of the side portions having a groove along an edge thereof and a lock opening, the side portions of the mounting bracket having aligned openings for receiving a fastener;

a leg assembly pivotally secured to each of the mounting brackets, the leg assembly being lockable in a raised position and lockable in a lowered position and having an adjustable length, the leg assembly comprising a tubular receiver pivotally secured to one of the mounting brackets and a tubular leg, the tubular receiver having upper openings and lower openings, the upper openings of the tubular receiver being aligned with the holes in the mounting bracket;

a fastener extending through the aligned holes in the mounting bracket and upper openings in the tubular receiver, the fastener defining a pivot axis for pivoting the leg assembly relative to the mounting bracket;

a first push pin assembly secured inside the tubular receiver, the first push pin assembly including a first push pin extending through one of the upper openings in the tubular receiver;

a tubular leg sized to fit inside the tubular receiver, the tubular leg having at least one opening extending through a wall of the tubular leg;

a second push pin assembly secured inside the tubular leg, the second push pin assembly including a second push pin extending through the opening in the tubular leg and through one of the lower openings in the tubular receiver to fix the length of the leg assembly;

wherein the first push pin extends through one of the lock openings in the mounting bracket when the leg assembly is in its lowered position and fits inside one of the grooves of the mounting bracket when the leg assembly is in its raised position.

16. The adjustable bed base of claim 15, further comprising an end cap secured inside one end of the tubular leg.

17. The adjustable bed base of claim 15, wherein the push pin assembly includes a generally C-shaped spring and the push pin being secured to one end of the C-shaped spring.

18. The adjustable bed base of claim 15, further comprising a foam border around the articulated deck.

19. The adjustable bed base of claim 15, wherein the leg assemblies are inside the foldable frame when the adjustable bed is folded.

* * * * *